United States Patent [19]

Hetrick

[11] 4,136,476

[45] Jan. 30, 1979

[54] SAFETY DEVICE FOR PORTABLE FIREARMS

[75] Inventor: George Hetrick, Walnut Creek, Calif.

[73] Assignee: Richard L. Gorman, Walnut Creek, Calif. ; a part interest

[21] Appl. No.: 834,713

[22] Filed: Sep. 19, 1977

[51] Int. Cl.[2] ..... F41C 27/00

[52] U.S. Cl. ..... 42/1 LP

[58] Field of Search ..... 42/1 LP, 1 N

[56] References Cited

U.S. PATENT DOCUMENTS

| | | | |
|---|---|---|---|
| 2,559,376 | 7/1951 | Schnitger | 42/1 N |
| 2,763,081 | 9/1956 | Huckabee | 42/1 LP |
| 3,137,957 | 6/1964 | Ingalls | 42/1 LP |
| 3,708,901 | 1/1973 | Wolter | 42/1 LP |
| 3,813,802 | 6/1974 | DiProspers | 42/1 N |

*Primary Examiner*—Charles T. Jordan

*Attorney, Agent, or Firm*—Edward B. Gregg; J. Michael Rosso

[57] ABSTRACT

A metallic cartridge plug corresponding in dimensions to cartridges used in a firearm and having a screw disposed through an opening in its closed end is insertable within the firing chamber of the firearm and is free to rotate therein about its longitudinal axis. The threaded end of a telescoping rod is inserted through the barrel of the firearm and threaded into the screw disposed on the cartridge plug. A cap having a diameter substantially in excess of the bore diameter of the firearm is affixed to the outer end of the telescoping rod, such that the telescoping rod can be telescoped to bring the cap flush against the muzzle end of the barrel. The telescoping rod can not be unthreaded from the cartridge plug without simultaneously pulling and turning the cap affixed to the telescoping rod.

8 Claims, 5 Drawing Figures

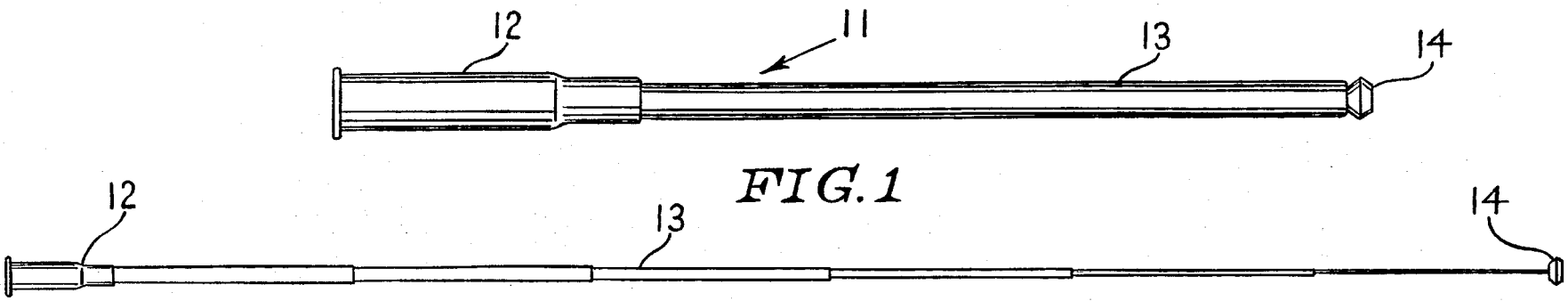
FIG. 1
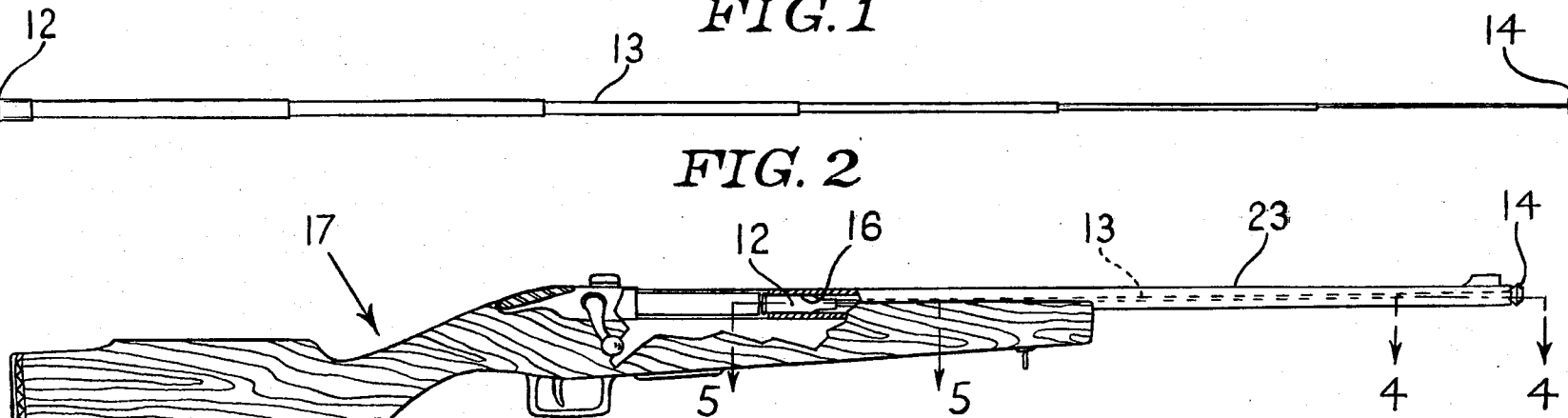
FIG. 2
FIG. 3
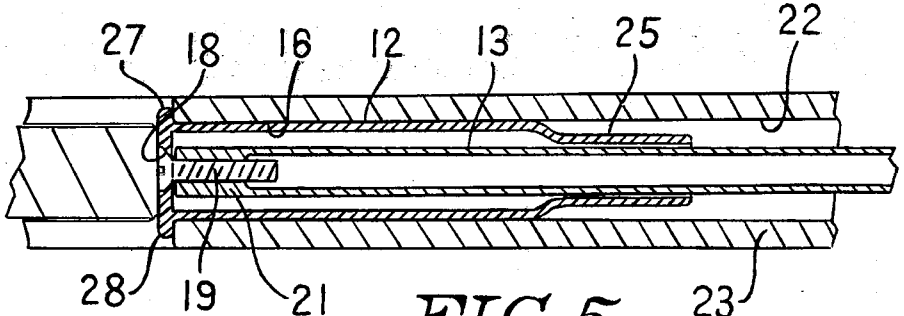
FIG. 5
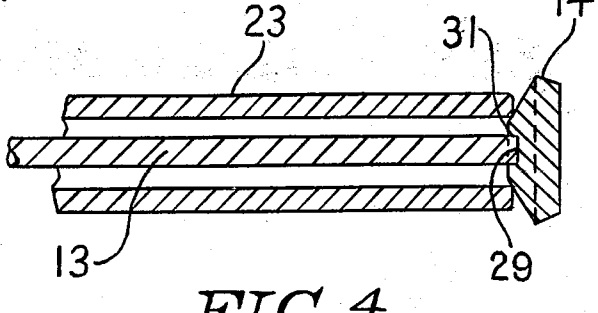
FIG. 4

SAFETY DEVICE FOR PORTABLE FIREARMS

BACKGROUND OF THE INVENTION

This invention relates to safety devices for portable firearms, and more particularly to a child-proof safety device which can be used in the field.

A variety of safety devices are presently available for rifles, pistols, shotguns and other portable firearms. Typical devices, such as those disclosed in U.S. Pat. Nos. 3,154,874, 3,193,959 and 3,208,176, call for a plug which is placed in the firearm to prevent a live round from being accidentally inserted therein. Such plugs can be locked into place so that children cannot easily remove or dislodge them. Other safety devices, such as those disclosed in U.S. Pat. Nos. 3,137,957 and 3,022,598, include rods or cables, which pass through the barrel, together with dummy rounds or other means disposed within the firing chamber for preventing the insertion of a live round. Such devices may also be locked to make them child-proof. Other patents of interest are:

| | |
|---|---|
| 3,813,802 | (Prospero, 1973) |
| 3,382,596 | (Rockwood, 1966) |
| 3,027,674 | (Mahan, 1959) |
| 2,997,802 | (Robbins, 1959) |
| 2,937,666 | (Maisch, 1957) |
| 2,887,807 | (Santangelo 1959) |
| 2,763,081 | (Huckabee, 1953) |
| 2,559,376 | (Schnitger, 1947) |
| 2,327,334 | (Parker, 1941) |

None of the above disclosed devices has provided a simple, inexpensive and yet effective means for rendering a firearm safe, easpecially as to young children. Also, none of such devices has proven practical for in-field use, whle at the same time offering satisfactory protection for children and unwary adults.

SUMMARY OF THE INVENTION

In accordance with this invention there is provided a safety device for portable firearms having a metallic cartridge plug which is inserted into the firing chamber of the firearm, the plug being rotatable within the chamber about its longitudinal axis and also having threaded means for receiving the end of a telescoping rod which is inserted into and through the barrel of the firearm. The outer end of the telescoping rod has a cap affixed thereto, the cap having a diameter substantially in excess of the bore diameter of the firearm.

A firearm, such as a rifle, shotgun, or pistol, can be quickly and easily rendered safe by placing the cartridge plug in the empty firing chamber, inserting the threaded end of the telescoping rod through the barrel and threading such end into the threaded means of the cartridge plug, and telescoping the telescoping rod until the cap is flush against the muzzle end of the barrel.

With the cartridge plug and telescoping rod in place within a firearm, a live round cannot be placed within the firing chamber. The cartridge plug can only be ejected from the firing chamber after the telescoping rod has been disconnected from it. In order to effect such disconnection it is necessary to exert a pulling pressure along the axis of the rod while at the same time turning the cap to unscrew the rod from the cartridge plug. A simple turning of the cap will result in no more than the rotation of the cartridge plug within the firing chamber, whereas a pulling action alone obviously will fail to unscrew the rod from the plug. Children will be unable to remove the telescoping rod from the cartridge plug and therefore will not be able to eject the cartridge plug and place a live round in the firing chamber.

The safety device of this invention can be provided in the form of a kit including a telescoping rod having one end threaded and a cap affixed to the other end, together with a variety of different size cartridge plugs, corresponding to various calibers of firearms. That is, cartridge plugs will correspond in dimensions to the cartridges actually used in the firearms. Thus, when the user assembles one of his firearms for transport or use in the field it will only be necessary to select an appropriate cartridge plug, place it in the firing chamber of such firearm, and insert the telescoping rod through the barrel and thread it into the cartridge plug. Similarly, a variety of different diameter caps can be provided, with the caps being screwable onto and off of the outer end of the telescoping rod, such that bore diameters of various sizes can be accommodated.

It is therefore a primary object of this invention to provide a child-proof safety device which can be quickly and easily secured to and removed from a portable firearm.

It is another object of this invention to provide a safety device for portable firearms which is both practical and effective for use in the field.

It is another object of this invention to provide a safety device for portable firearms which also protects the bore from dirt or the like during transport of the firearm.

It is still another object of this invention to provide a safety device in the form of a kit having interchangeable cartridge plugs together with a telescoping rod so that the safety device can be used with pistols, shotguns, rifles and other firearms having differing firing chamber sizes and barrel lengths.

It is yet another object of this invention to provide a simple and inexpensive safety device for portable firearms, and one which can be easily and inexpensively repaired or replaced.

These and other objects of the invention will become apparent to those skilled in the art from a reading of the description of the preferred embodiment, as well as from examining the following described drawings.

BRIEF DESCRIPTION OF THE DRAWINGS

FIG. 1 is a side elevational view of the safety device of this invention showing the telescoping rod in telescoped position such that the device can be easily transported in the field.

FIG. 2 is a side elevational view similar to that of FIG. 1, showing the telescoping rod in extended position.

FIG. 3 is a partially cut away sectional view showing the cartridge plug and telescoping rod in place on a firearm.

FIG. 4 is a fragmentary sectional view taken along line 4—4 of FIG. 3 showing the positioning of the cap against the muzzle end of the firearm barrel.

FIG. 5 is an enlarged sectional view taken along line 5—5 of FIG. 3 showing the cartridge plug in place on a firearm.

DESCRIPTION OF THE PREFERRED EMBODIMENTS:

Safety device 11 comprises a metallic cartridge plug 12, a telescoping rod 13, and a cap 14 affixed to the outer end of the telescoping rod. As shown by FIGS. 1 and 2, the telescoping rod can be extended to about three times its telescoped length. Accordingly, the fully extended safety device can be used in firearms having barrel lengths up to about three feet. Also, such safety devices can be used in pistols or other short barrel firearms, with the telescoping rod retracted or telescoped to give a total length of less than about one foot.

Cartridge plug 12 is formed of any metallic substance, such as steel or the like, which will not rupture or become deformed when someone attempts to eject the cartridge plug from the firing chamber without having detached the telescoping rod therefrom. Preferably, the cartridge plug 12 if formed of brass. For example, used brass cartridge cases can be provided with threaded means and employed as metallic cartridge plugs in accordance with this invention. Since brass cartridge cases for almost every caliber of firearm are readily available, the use of such a casing as a cartridge plug would further tend to reduce the cost of such safety devices.

The telescoping rod 13, as well as the cap 14, are preferably formed of a metallic substance, with aluminum being especially preferred. Alternatively, a hard plastic may be untilized, especially where concern with damage to the bore of the firearm may be a problem.

As shown in FIG. 3 cartridge plug 12 occupies the firing chamber 16 of firearm 17 in exactly the same fashion as would a live cartridge corresponding to the caliber of such firearm. As shown in FIG. 5, an aperture 18 is located at the base of the cartridge plug and receives a screw 19 onto which is threaded end 21 of telescoping rod 13, which end has been inserted through the bore 22 of barrel 23 and through the narrow opening 25 of the cartridge plug 12.

Cartridge plug 12 is disposed in firing chamber 16 so that it is free to rotate about its longitudinal axis, such that when a turning motion alone is imparted to cap 14 the telescoping rod 13 will not unthread from the screw 19 but will merely cause the cartridge plug 12 to rotate within the firing chamber. That is, to unthread the telescoping rod from the catridge plug it is also necessary to simultaneously exert a pulling pressure on the cap 14 so as to bring base 27 of the cartridge plug in abutment with shoulder 28 of the firing chamber, to thereby resist the turning or rotating movement of the cartridge plug and allow the turning of cap 14 to unscrew the telescoping rod 13 from the cartridge plug 12. Such feature renders the firearm safe for children or others who might attempt to pull out the telescoping rod or eject the cartridge plug from the firing chamber so as to be able to insert a live round therein.

Any alternate threaded means may be disposed on the cartridge plug for receiving the threaded end of the telescoping rod. For example, the narrow portion 25 of the cartridge plug 12 can be provided with threads along its inner diameter, such that the threaded end 21 of the telescoping rod 13 need only be screwed into the neck of the cartridge plug.

As shown in FIG. 4, the diameter of cap 14 is substantially in excess of the bore diameter 22 of barrel 23 of the firearm 17. After the threaded end of the telescoping rod has been threaded into the cartridge plug 12 within the firing chamber 16, pressure can be exerted on the cap to telescope the rod and move the cap 14 flush against the end of barrel 23.

Cap 14 can be provided with a threaded opening 29 for receiving a threaded outer end 31 of the telescoping rod 13, such that cap 14 can be screwed onto and off of end 31. Accordingly, a cap 14 of one diameter size can be unscrewed from the telescoping rod and replaced by a cap of another diameter, to accommodate a different bore diameter. A rubber washer may be disposed on the inner side of the cap, between the cap and the end of barrel 22, for providing improved sealing of the barrel.

The safety device of this invention is especially valuable in the form of a kit including a single telescoping rod, a number of varying diameter caps, and a number of cartridge plugs of differing caliber. Accordingly, it will only be necessary to select from the kit the cap appropriate to the bore diameter of the gun in which the safety device is to be used, together with a cartridge plug corresponding to the cartridges actually used in such firearm.

I claim:

1. A safety device for a portable firearm having a firing chamber and barrel, comprising:
   - a metallic cartridge plug insertable into the firing chamber of the firearm, the plug being rotatable within the chamber about its longitudinal axis and having threaded means,
   - a telescoping rod insertable into and through the barrel of the firearm and into threading relationship with the cartridge plug, and
   - a cap affixed to the outer end of the telescoping rod, the cap having a diameter substantially in excess of the bore diameter of the firearm.

2. The safety device of claim 1 wherein the cartridge plug is a brass cartridge case having an aperture at its closed end, wherein the threaded means comprises a screw insertable through the aperture of the cartridge plug, and wherein the inner end of the telescoping rod is threaded to receive the screw disposed in the cartridge plug.

3. The safety device of claim 1 wherein the cartridge plug is a brass cartridge case having threads around its inside surface at the outer end thereof, and wherein the telescoping rod has a threaded end portion insertable and threadable into the threaded outer end of the brass cartridge case.

4. The safety device of claim 1 wherein the outer end of the telescoping rod and the cap are threaded such that the cap can be screwed onto and off the outer end of the telescoping rod.

5. The safety device of claim 1 wherein the telescoping rod is extensible to at least three times its telescoped length.

6. A safety device kit for portable firearms of different caliber and having firing chambers, comprising:
   - a telescoping rod threaded at one end and having a cap affixed to the opposite end, the cap having a diameter substantially in excess of the bore diameter of each of the firearms, and
   - at least two metallic cartridge plugs having calibers corresponding to those of the firearms, each plug being insertable into the firing chamber of the firearm of corresponding caliber, and each plug being rotatable within each firing chamber about its longitudinal axis and having threaded means for receiving the threaded end of the telescoping rod.

7. The safety device kit of claim 6 wherein the cartridge plugs comprise brass cartridge cases.

8. The safety device kit of claim 6 wherein the cap affixed to the telescoping rod can be screwed onto and off of said rod, and additionally comprising removable caps of varying diameters such that bore diameters of various sizes can be covered by said caps.

* * * * *